United States Patent [19]

Park et al.

[11] 3,993,555

[45] Nov. 23, 1976

[54] METHOD OF SEPARATING BITUMEN FROM TAR SAND WITH COLD SOLVENT

[75] Inventors: Jack H. Park, Houston; Joseph C. Allen, Bellaire, both of Tex.

[73] Assignee: Texaco Inc., New York, N.Y.

[22] Filed: May 16, 1975

[21] Appl. No.: 578,223

[52] U.S. Cl. ..... 208/11 LE; 210/71

[51] Int. Cl.[2] ..... C10G 1/04

[58] Field of Search ..... 208/11; 210/71

[56] References Cited

UNITED STATES PATENTS

| | | | |
|---|---|---|---|
| 3,114,694 | 12/1963 | Bergougnou et al. | 208/11 R |
| 3,751,358 | 8/1973 | Elliot | 208/11 LE |

*Primary Examiner*—Delbert E. Gantz
*Assistant Examiner*—James W. Hellwege
*Attorney, Agent, or Firm*—T. H. Whaley; C. G. Ries; Kenneth R. Priem

[57] ABSTRACT

A method for separating bitumen from tar sand by solvent extraction with efficient separation of water from the recovered bitumen is disclosed. Tar sand may often be recovered by surface mining techniques. The tar sand is comprised of bitumen, water and sand including clays. The tar sand is contacted with bitumen solvent having a freezing point below that of the water, and the temperature of the mixture is lowered below the freezing point of the water in the tar sand. The solid ice crystals may then be easily removed along with the sand leaving a water-free liquid bitumen solvent mixture.

20 Claims, 2 Drawing Figures

EXTRATION OF ATHABASCA TAR FROM TAR SAND BY MULTIPLE STAGE LEACHING AT −2°F

METHOD OF SEPARATING BITUMEN FROM TAR SAND WITH COLD SOLVENT

BACKGROUND OF THE INVENTION

1. Field of the Invention

This invention relates to a process for recovering petroleum from tar sands by use of a solvent.

2. Description of the Prior Art

Throughout the world there are various known locations wherein the earth contains large deposits of tar sands. For example, one of the most extensive and best known deposits of this type occurs in the Athabasca district of Alberta, Canada. In the tar sands, the oil typically has a density approaching or even greater than that of water. The Athabasca tar sands extend for many miles and occur in varying thicknesses up to more than 200 feet. In many places, the Athabasca tar sands are disposed practically on the surface of the earth. These areas lend themselves to open pit mining operations. The oil content ranges between about 10 and 20 percent by weight; although sands with lesser or greater amounts of oil content are not unusual. Additionally, the sands generally contain small amounts of water in the range from about one to ten percent by weight.

The oil present and recoverable from tar sands is usually a rather viscous material ranging in specific gravity from slightly below 1.00 to about 1.04 or somewhat greater. At a typical reservoir temperature of about 48° F, this oil is immobile, having a viscosity exceeding several thousand centipoise. At higher temperatures such as those above 200° F, or diluted with a suitable solvent, the oil becomes mobile with viscosities of less than about 343 centipoise. Since this tarry material does not generally command a very high price, particularly in its crude state, its separation and recovery must involve a minimum of expenditure in order to economically attractive for commercial practice.

Surface mining techniques for tar sands are well known. Two approaches are generally followed. In the first, a few mining units of custom design are used. These are generally larger units and may be bucket wheel excavators, dredges (both hydraulic and bucket lifter), and super-sized draglines. The second general mining technique is to use many smaller mining units of conventional design. For example, scrapers and truck and shovel operations are typical. Once the tar sand has been recovered by these methods, a ball mill or other similar device may be used to pulverize the tar sand into small pieces suitable for the various recovery techniques. One such recovery technique is solvent extraction. The solvent extractions heretofore attempted, however, have been done at temperatures above the freezing point of the water in the tar sands. As the solvent dilutes the bitumen during these operations, the bitumen and the liquid water form tight emulsions which become a very difficult problem in processing since they are not easily broken. These emulsion problems are well known and are a leading cause of the economic failure of some solvent processes. (See Kirk-Othmer Encyclopedia of Chemical Technology, Vol. 19, page 706).

This invention discloses a way to solve the emulsion problem by preventing the water contained in the tar sands from forming emulsions with the bitumen.

SUMMARY OF THE INVENTION

The invention is a method for extracting bitumen from the tar sand at or near the surface of the earth comprising contacting the tar sand with a bitumen solvent having a freezing point below the freezing point of any water in the tar sand, separating the dissolved bitumen solvent and any attendant water from the sand and lowering the temperature of the bitumen solvent and the attendant water to a point which will freeze the water. The frozen water is then separated from the dissolved bitumen and the solvent. The frozen water is then separated from the dissolved bitumen and solvent by conventional means such as centrifuging or filtering. Alternatively, the method of this invention envisions contacting a tar sand with a bitumen solvent having a freezing point below the freezing point of any water in the tar sand wherein the solvent is at a temperature sufficiently low to freeze any water in the tar sand deposit upon contact.

Much of the formation water frozen by the cold solvent will remain in the formation. That which is produced will be separated in the manner described above.

DESCRIPTION OF THE PREFERRED EMBODIMENTS

Figure 1:
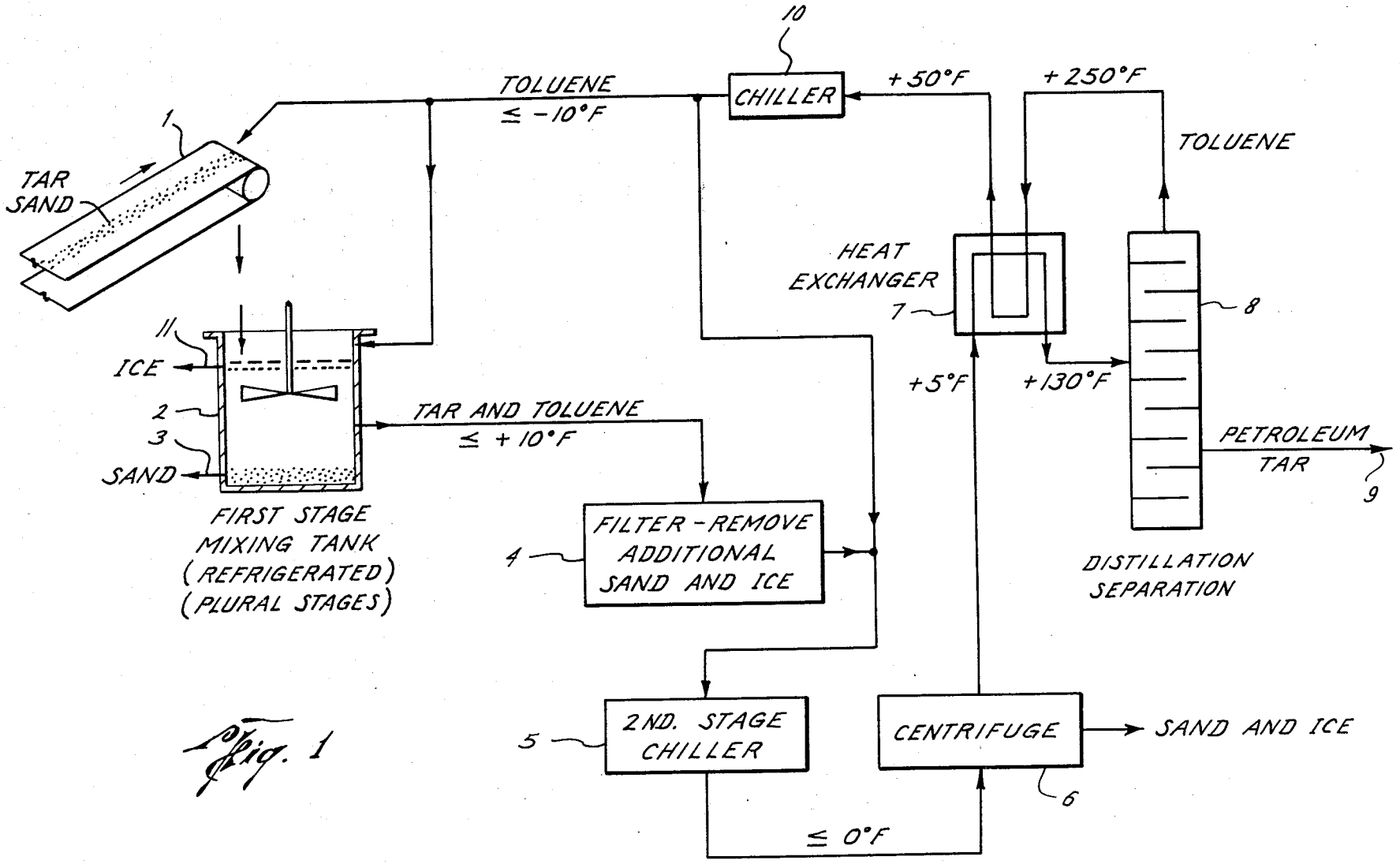
FIG. 1 illustrates a typical embodiment of the invention.

The invention is a tar sand recovery and separation technique wherein mined tar sand is separated into its component parts, that is, sand, clay, water and petroleum. The invention may be better understood by reference to the attached FIG. 1 upon which is schematically depicted a typical embodiment of the invention. This embodiment is not intended to limit the invention in any way and is only given for illustration.

Mined tar sand is carried by conveyor 1 and deposited in a tank 2 which contains toluene at about −10° F. The mined tar sand and cold toluene are thoroughly mixed and sand is removed at 3 and ice at 11 by gravity separation and settling. The tar and toluene are then transported to a filter 4 to remove additional sand and crystalline ice. The upgraded tar and toluene mixture is then moved to another chiller 5 wherein the temperature is once again lowered to about 0° F. After this chilling operation, the tar and toluene mixture is moved to a centrifuge 6 wherein any additional sand and ice crystals are removed. The now sand- and ice-free tar and toluene mixture is routed through a heat exchanger to raise its temperature from about 5° to about 130° F wherein this hot tar and toluene mixture is introduced into a distillation tower 8 and the toluene and petroleum are separated. The petroleum from the tar sand is removed at 9 and the toluene is the overhead at about 250° F. This toluene is routed through heat exchanger 7 to raise the temperature of the incoming tar and toluene mixture to the distillation tower. After emerging from the heat exchanger at about 50° F, the recovered toluene is introduced into a chiller 10 wherein the temperature of the toluene is lowered to −10° F. This toluene is then routed back into the first phase separator 2 to be mixed with more incoming tar sand.

The solvent used in the method of the invention may be any material capable of dissolving bitumen contained in tar sands.

Aliphatic or aromatic hydrocarbons capable of dissolving bitumen are suitable for the process of my invention. Mixtures of aliphatic and aromatic hydrocarbons may also be used as well as hydrocarbons containing both aromatic and aliphatic characteristics. Suitable aromatic hydrocarbons include mononuclear and polynuclear species.

Aliphatic hydrocarbons, preferably linear or branched paraffinic hydrocarbons having from 4 to 10 carbon atoms, are suitable materials for use in practicing the process of the invention. For example, butane, pentane, hexane, heptane, octane, etc. and mixtures thereof as well as commercial blends such as natural gasoline will function as a satisfactory liquid solvent for many bitumens. Of course, any solvent used in the process of the invention must have a freezing point well below that of any water contained in the tar sand. Also, it has been noted that many aliphatic hydrocarbons will not totally dissolve some bitumens. Thus in selecting an aliphatic hydrocarbon, it may be well to thoroughly test samples of the bitumen to be recovered in the laboratory with a series of solvents to choose the one most likely to dissolve the greatest amount of bitumen.

Most mononuclear aromatic hydrocarbons, however, will dissolve bitumen totally and therefore, they are excellent candidates for solvents in the process of the invention. However, many of these mononuclear aromatic hydrocarbons have a freezing point above that of water. These are unacceptable for the process of the invention. Solvents which have a very low freezing point are particularly preferred. This class includes but is not necessarily limited to toluene, meta-xylene and orthoxylene. A mixture of an aliphatic hydrocarbon such as pentane and an aromatic hydrocarbon such as toluene comprise an excellent solvent for use in our process. Mixed aromatic solvents are frequently available from processing streams of refineries and may contain a mixture of mononuclear aromatic aromatic hydrocarbons and a substantial amount of aliphatic hydrocarbons as well as many other types of hydrocarbons. Such materials may be economic solvents and frequently the materials are very satisfactory. Their ability to perform in the process of the invention may best be determined by simple tests utilizing the solvent under consideration and a sample of the bitumen from the formation at the low temperature at which the separation is to be performed. A freezing point test should also be undertaken to see if the solvents freeze at a point above that which will be used in the process.

Chlorinated methane including carbon tetrachloride or carbon disulfide are also suitable solvents for use in this process.

The particular temperature to be used in the process during the extraction stages is not critical as long as it is below the freezing point of the water in the tar sands and therefore able to form ice crystals so that the water can be removed as solid ice. Of course, the temperature of the tar sand and solvent mixture must be at least as low as the freezing point of water, that is 32° F (0° C) but it is also conceivable that the temperature must be below this point since the water contained in the tar sands may be contaminated by dissolved minerals or salts and have a freezing point below 32° F. Therefore, before undertaking the process of the invention, the water naturally occurring in the tar sand should be tested for its freezing point, and the operating temperature of the process then determined. These are steps well within the skill of the practitioner in the art and need not be explained in detail here.

The method of the invention may be performed in a variety of sequences all leading to the same result; that is, the water in the tar sands is converted to ice crystals, and these are then removed from the tar sand-solvent mixture. In one embodiment of the invention, the solvent is added to the tar sand at above the freezing point of the water in the tar sand and then the entire mixture is cooled to a temperature below the freezing point of the water in the tar sand. The sand and ice thus formed may then be easily removed by filtering and centrifuging. In another embodiment of the invention, the solvent is added to the tar sand at a temperature below the freezing point of the water in the tar sand and ice crystals are formed immediately upon mixing. The sand and ice is then separated mechanically by filtering and centrifuging. In yet another embodiment of the invention, the solvent is added to the tar sand at a temperature above the freezing point of the water in the tar sand and the sand is then separated from the mixture. At this point, the temperature of the remaining materials, principally butane, solvent and water, is lowered to a temperature below the freezing point of the water in the tar sand and the ice crystals thus formed are separated. This is a particularly attractive embodiment in that the energy otherwise required to reduce the temperature of sand present in the tar sand to below the freezing point of water is saved. Many other variations could be thought of by those skilled in the art armed with the teachings herein without departing from the scope of the invention.

EXPERIMENTAL

A series of multi-stage extractions (by leaching) were performed at −2° F. A sample (214 grams) of Athabasca Tar Sand was treated with toluene by stages at −2° F. The sample containing 13.23 weight percent tar and had "dried" out since it contained only 3 percent water and about a 20 percent gas saturation.

Figure 2:
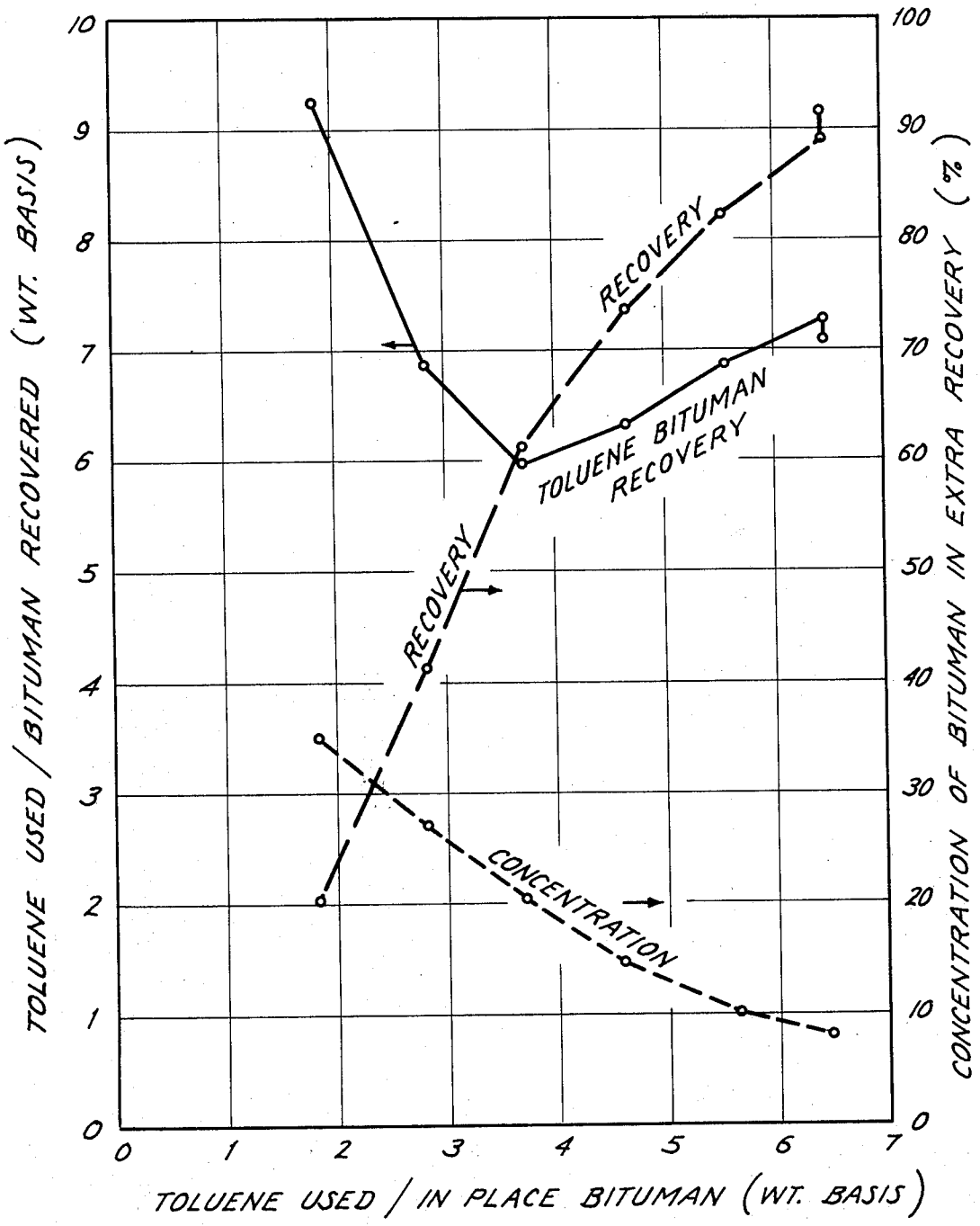
FIG. 2 depicts the efficiency of toluene as the extracting solvent.

FIG. 2 shows a recovery of 91%, an efficiency of 7.3 barrels of toluene for barrel of bitumen recovered and a tar concentration in the toluene extract decrease from 35 to 8% from the first to sixth stage. Initially, two units of toluene were required to obtain a supernatant liquid. The final points were obtained by permitting the system to warm to room temperature, washing with water and recovering additional supernatant extract.

The efficiency can be increased by washing with water earlier such as after treating with 2 to 4 units of toluene. Note that the maximum efficiency, without washing with water, occured at 3.7 parts of toluene per part of original in-place tar.

I claim:

1. A method for extracting bitumen from tar sand wherein a bitumen solvent having a freezing point below the freezing point of any water present in the tar sand is contacted with the tar sand and the dissolved liquid bitumen and solvent mixture is subsequently separated from the sand and water the improvement which comprises lowering the tar/sand solvent mixture to a temperature sufficient to freeze the water in the tar sand.

2. The method of claim 1 wherein the solvent comprises an aliphatic hydrocarbon.

3. The method of claim 2 wherein the solvent comprises an aliphatic hydrocarbon having from 4 to 10 carbon atoms.

4. The method of claim 1 wherein the solvent comprises an aromatic hydrocarbon.

5. The method of claim 4 wherein the solvent is selected from the group consisting of toluene, meta-xylene and ortho-xylene.

6. A method for extracting bitumen from tar sand wherein a bitumen solvent having a freezing point below the freezing point of any water present in the tar sand is contacted with the tar sand and the dissolved liquid bitumen and solvent mixture is subsequently separated from the sand and water the improvement which comprises contacting the bitumen with the solvent at a temperature sufficient to freeze the water in the tar sand.

7. The method of claim 6 wherein the solvent comprises an aliphatic hydrocarbon.

8. The method of claim 7 wherein the solvent comprises an aliphatic hydrocarbon having from 4 to 10 carbon atoms.

9. The method of claim 6 wherein the solvent comprises an aromatic hydrocarbon.

10. The method of claim 9 wherein the solvent is selected from the group consisting of toluene, meta-xylene and ortho-xylene.

11. A method for extracting bitumen from tar sand at or near the surface of the earth comprising:

a. contacting the tar sand with a bitumen solvent having a freezing point below the freezing point of any water in the tar sand at a temperature above the freezing point of the water in the tar sand;

b. separating the dissolved bitumen solvent and attendant water from the sand;

c. lowering the temperature of the bitumen, solvent and any attendant water to a point which will freeze the water; and d. separating the dissolved liquid bitumen and solvent mixture from the frozen water.

12. The method of claim 11 wherein the solvent comprises an aliphatic hydrocarbon.

13. The method of claim 12 wherein the solvent comprises an aliphatic hydrocarbon having from 4 to 10 carbon atoms.

14. The method of claim 11 wherein the solvent comprises an aromatic hydrocarbon.

15. The method of claim 14 wherein the solvent is selected from the group consisting of toluene, meta-xylene and ortho-xylene.

16. A method for extracting bitumen from tar sand at or near the surface of the earth comprising:

a. contacting the tar sand with a bitumen solvent having a freezing point below the freezing point of any water in the tar sand, the solvent being at a temperature sufficiently low to freeze any water in the tar sand after contact; and b. separating the dissolved liquid bitumen and solvent mixture from the sand and frozen water.

17. The method of claim 16 wherein the solvent comprises an aliphatic hydrocarbon.

18. The method of claim 17 wherein the aliphatic hydrocarbon has from 4 to 10 carbon atoms.

19. The method of claim 16 wherein the solvent comprises an aromatic hydrocarbon.

20. The method of claim 19 wherein the solvent is selected from the group consisting of toluene, meta-xylene and ortho-xylene.

* * * * *